US008228274B2

(12) United States Patent
Chung et al.

(10) Patent No.: US 8,228,274 B2
(45) Date of Patent: Jul. 24, 2012

(54) LIQUID CRYSTAL PANEL, LIQUID CRYSTAL DISPLAY, AND DRIVING METHOD THEREOF

(75) Inventors: Te-Chen Chung, Kun Shan (CN); Chia-Te Liao, Kun Shan (CN); Yu-wen Chiu, Kun Shan (CN)

(73) Assignee: Infovision Optoelectronics (Kunshan) Co., Ltd., Kunshan (CN)

( * ) Notice: Subject to any disclaimer, the term of this patent is extended or adjusted under 35 U.S.C. 154(b) by 756 days.

(21) Appl. No.: 12/335,536

(22) Filed: Dec. 16, 2008

(65) Prior Publication Data

US 2009/0322660 A1 Dec. 31, 2009

(30) Foreign Application Priority Data

Jun. 30, 2008 (CN) ..... 2008 1 0126039

(51) Int. Cl.
*G09G 3/36* (2006.01)

(52) U.S. Cl. ..... 345/87

(58) Field of Classification Search ..... None
See application file for complete search history.

(56) References Cited

U.S. PATENT DOCUMENTS 6,320,566 B1 * 11/2001 Go ..... 345/99
6,429,842 B1 * 8/2002 Shin et al. ..... 345/92
6,489,952 B1 * 12/2002 Tanaka et al. ..... 345/205
7,570,241 B2 * 8/2009 Kim et al. ..... 345/94
7,898,515 B2 * 3/2011 Moon et al. ..... 345/96
7,907,136 B2 * 3/2011 Kobayashi ..... 345/208
2006/0187164 A1 8/2006 Okuno
2009/0262061 A1 * 10/2009 Chung et al. ..... 345/100

FOREIGN PATENT DOCUMENTS

CN 1825415 A 8/2006
CN 101251697 A 8/2008

OTHER PUBLICATIONS

Rejection of CN200810126039 by State Intellectual Property Office, China, Apr. 28, 2010.
Rejection of CN200810126039 by State Intellectual Property Office, China, Aug. 19, 2010.

* cited by examiner

*Primary Examiner* — K. Wong
(74) *Attorney, Agent, or Firm* — Perkins Coie LLP; Aaron Wininger

(57) ABSTRACT

A liquid crystal panel, a liquid crystal display, and a driving method thereof are disclosed. The liquid crystal panel comprises scanning lines, data lines, and a plurality of pixels, each of the plurality of pixels including a TFT, a pixel electrode, a first common electrode, and a second common electrode. The first common electrodes of first pixels of the plurality of pixels are electrically connected via a first common line, the first common electrodes of second pixels of the plurality of pixels are electrically connected via a second common line, and the second common electrodes of the plurality of pixels are electrically connected.

4 Claims, 8 Drawing Sheets

| | | | | | |
|---|---|---|---|---|---|
| + | − | + | − | + | − |
| − | + | − | + | − | + |
| + | − | + | − | + | − |
| − | + | − | + | − | + |
| + | − | + | − | + | − |
| − | + | − | + | − | + |
| + | − | + | − | + | − |
| − | + | − | + | − | + |

LIQUID CRYSTAL PANEL, LIQUID CRYSTAL DISPLAY, AND DRIVING METHOD THEREOF

CROSS REFERENCE TO RELATED APPLICATION

This application claims the benefit of priority from Chinese Patent Application No. 2008101260392 filed on Jun. 30, 2008, the entire content of which is hereby incorporated by reference.

FIELD OF THE INVENTION

The invention relates to the field of liquid crystal displays, and in particular to a liquid crystal panel, a liquid crystal display, and a driving method thereof.

BACKGROUND OF THE INVENTION

Liquid crystal displays (LCDs) have found wide applications in modern electronic devices such as personal computer screens, liquid crystal televisions, cell phones or Personal Digital Assistants (PDAs) due to their advantageous characteristics of low power consumption, light weight, thin profile, etc.

In general, an LCD controls light transmittance of liquid crystal by an electrical field so as to display images. In terms of the electrical field's driving direction, liquid crystals can be roughly sorted into a horizontal electrical field type and a vertical electrical field type. An LCD of the horizontal electrical field type drives the liquid crystal in an In-Plane Switching (IPS) mode by using a horizontal electrical field formed between a pixel electrode and a common electrode that are provided parallel to each other on a lower substrate. An LCD of the vertical electrical field type drives the liquid crystal in an Twisted Nematic (TN) mode by using the vertical electrical field between a pixel electrode and a common electrode that are provided opposite to each other on a lower and an upper substrates respectively.

For LCDs, there is a simplified matrix type, an active matrix type in which active elements such as TFTs (Thin Film Transistors) are used in pixels, and so on. The driving methods of an LCD of the active matrix type include frame-inversion driving, H line-inversion (row-inversion) driving, V line-inversion (column-inversion) driving, dot-inversion driving, and the like. LCDs of the active matrix type using different driving methods will be described below by way of example with reference to the accompanying drawings.

An LCD using column-inversion driving is schematically described with reference to FIGS. 1 and 2. FIG. 1 is a schematic view of the polarities of pixels of a liquid crystal panel of an LCD when the LCD employs column-inversion driving. As shown in FIG. 1, in the current frame, the polarities of the pixels of odd columns are positive, and the polarities of the pixels of even columns are negative. FIG. 2 is a schematic circuit diagram of part of pixels of the liquid crystal panel as shown in FIG. 1. For the purposes of clarity and ease of illustration, only part of the circuit structure is shown in FIG. 2. As shown in FIG. 2, gate electrodes 20*g* of TFTs 20 in the pixels in the same row are connected to the same scanning line, the pixels in the same column have the same polarity, source electrodes 20*s* of TFTs 20 in the pixels in the same column are connected to the same data line, and a drain electrode 20*d* of TFT 20 in each of the pixels is connected to a corresponding pixel electrode 22. For example, the gate electrodes 20*g* of TFTs 20 in pixels of the first row are connected to a scanning line G1, the pixels of the first column have positive polarity in the current frame, and the source electrodes 20*s* of TFTs 20 in the pixels of the first column are connected to a data line D1.

An LCD using dot-inversion driving is schematically described with reference to FIGS. 3 and 4. FIG. 3 is a schematic view of the polarities of pixels of a liquid crystal panel of an LCD when the LCD employs the dot-inversion driving. As shown in FIG. 3, in contrast to column-inversion driving and other driving methods, the polarity of each pixel is different from that of adjacent columns and adjacent rows of the pixels thereof FIG. 4 is a schematic circuit diagram of part of the pixels of the liquid crystal panel as shown in FIG. 3. Also for the purposes of clarity and ease of illustration, only part of the circuit structure is shown in FIG. 4. As shown in FIG. 4, gate electrodes 40*g* of TFTs 40 in the pixels of odd columns in the two adjacent rows are connected to the same scanning line, gate electrodes 40*g* of TFTs 40 in the pixels of even columns in the two adjacent rows are connected to another scanning line, source electrodes 40*s* of TFTs 40 in the pixels in the same column that have the same polarity are connected to the same data line, and a drain electrode 40*d* of the TFT 40 in each of the pixels is connected to a corresponding pixel electrode 42. For example, in FIG. 4, the gate electrodes 40*g* of the TFTs 40 in the pixels P11, P13, P21, and P23 are connected to the scanning line G1, the gate electrodes 40*g* of the TFTs 40 in the pixels P22, P24, P32, and P34 are connected to the scanning line G2, and the source electrodes 40*s* of the TFTs 40 in the pixels P11 and P31 are connected to the data line D1.

A conventional liquid crystal panel of the active matrix type generally comprises n rows of scanning lines that are parallel to each other, m columns of data lines that are parallel to each other and that are perpendicular to and insulated with the n rows of scanning lines, and a plurality of pixels. Each pixel comprises a TFT, a liquid crystal capacitor $C_{LC}$, and a storage capacitor $C_{st}$. The TFT is located at the intersection of a scanning line and a data line, and functions as a switch element to drive a pixel electrode. The gate electrode of the TFT is connected to a scanning line so as to receive scanning signals transmitted by the scanning line, the source electrode is connected to a data line, and the drain electrode is connected to the pixel electrode. The minimum region surrounded by the scanning lines and the data lines is defined as a pixel region. Each row of pixels includes m pixel electrodes. A liquid crystal capacitor $C_{LC}$ is formed between a pixel electrode and a common electrode of an opposite substrate (also referred to as an opposite electrode). A storage capacitor $C_{st}$ is formed between a pixel electrode and a common electrode of an array substrate (also referred to as a storage electrode).

A first end of a liquid crystal capacitor (i.e., pixel electrode) is coupled to a data line via the drain electrode and the source electrode of a TFT, and a second end of the liquid crystal capacitor is connected to an opposite substrate to receive a common voltage signal Vcom. A first end of a storage capacitor is connected with the first end of the liquid crystal capacitor, and a second end of the storage capacitor is connected to an array substrate to receive the common voltage signal Vcom. When the liquid crystal panel is scanned, a plurality of scanning signals are generated in the time of a frame, which are applied to the respective scanning lines. When a TFT is turned on by a scanning signal, a data signal voltage is transmitted to the first end of the liquid crystal capacitor and the first end of the storage capacitor through the source electrode and the drain electrode of the TFT, thereby charging the liquid crystal capacitor and the storage capacitor.

The waveforms of the pixel voltage, data signal voltage, common voltage signal and scanning signal of a pixel in a conventional liquid crystal panel (for example, the liquid crystal panels as shown in FIGS. 1-4) when it is driven will be described with reference to FIGS. 5A and 5B. In FIGS. 5A and 5B, Vgh represents the high voltage of a scanning line (also referred to as scanning start-up signal), Vgl represents the low voltage of the scanning line, Vsig1 and Vsig2 represent data signal voltages supplied to a data line, Vpixel represents a voltage by which a pixel electrode is charged (also referred to as pixel voltage), and Vcom represents the common voltage signal that is supported to the common electrode of the pixel.

FIG. 5A is a waveform diagram of the pixel voltage, data signal voltage, common voltage signal and scanning signal of a certain pixel connected on an odd data line as shown in FIGS. 2 and 4. For the purposes of clarity and ease of illustration, only the waveforms regarding to the nth and (n+1)th frames are shown in FIG. 5A. As shown in FIG. 5A, for the nth frame, during applying the scanning start-up signal to a certain scanning line, the high voltage Vgh turns on the TFTs connected on the scanning line, that is, the drain electrodes and source electrodes s of the TFTs feed through. During this period, a data signal voltage Vsig1 that represents the pixel voltage of the nth frame is applied by the data line to the pixel electrodes through the source electrodes and drain electrodes of the TFTs, whereby the pixels connected on the scanning line show a pixel voltage Vpixel and the storage capacitors in these pixels are in a charging state. The pixel voltage Vpixel is maintained by the storage capacitors within the subsequent time of the frame. Theoretically, the pixel voltage Vpixel shown by the pixels connected on the scanning line will maintain unchanged before the scanning start-up signal of the (n+1)th frame is applied to the scanning line. In practice, however, at the moment the scanning signal transits from the high voltage Vgh to a low voltage Vgl, the TFTs cut off, the charging voltages of the liquid crystal capacitors that are maintained by the storage capacitors will drop suddenly due to the capacitance coupling effect, and decreases a little due to the influence of the adjacent parasitic resistances after the scanning signal keeps at the low voltage Vgl.

When the scanning start-up signal of the (n+1)th frame is applied to the scanning line, the polarity of the pixels connected on the scanning line is reversed. Similarly to the nth frame, during applying the scanning start-up signal of the (n+1)th frame to the scanning line, the high voltage Vgh turns on the TFTs connected on the scanning line. Meanwhile, a data signal voltage Vsig1 that represents the pixel voltage of the (n+1)th frame is applied by the data line to the pixel electrodes through the source electrodes and drain electrodes of the TFTs, whereby the pixels connected on the scanning line are updated to show a pixel voltage Vpixel of the (n+1)th frame and the storage capacitors in these pixels are in a charging state. The pixel voltage Vpixel is maintained by the storage capacitors within the subsequent time of the frame. It goes repeats continuously as such.

FIG. 5B is a waveform diagram of the pixel voltage, data signal voltage, common voltage signal and scanning signal of a certain pixel connected on an even data line as shown in FIGS. 2 and 4. For the purposes of clarity and ease of illustration, only the waveforms regarding to the nth and (n+1)th frames are shown in FIG. 5B. The waveform of the pixel voltage of the pixels connected on even data lines is inverted from that of the pixels connected on odd data lines because the polarity of the pixels connected on the even data lines is inverse from that of the pixels connected on the odd data lines, that is, because the pixel voltage of the pixels connected on the even data lines is inverse in a same frame from that of the pixels connected on the odd data lines. Since in this case, FIG. 5B can be clearly understood with reference to the description made in FIG. 5A, the detailed description thereof is omitted herein.

When a conventional liquid crystal panel displays pixel voltages, if there is a difference between the images of two consecutive frames of pictures, then image sticking is readily produced. This is because the liquid crystal material has a slow reaction speed and long reaction time. Moreover, when an object in the pictures moves rapidly, the liquid crystal material cannot track the movement of the object in real time during scanning one picture. In this case, what the liquid crystal material generates is the accumulative reaction of several instances of picture scanning. In order to solve the afterimage problem, a large number of research reports have been proposed with respect to the special characteristics of the liquid crystal material, which focus on the following aspects: (1) intrinsic properties: changing the stickiness of liquid crystal to a low viscosity; (2) increasing the twisting voltage, i.e., over driving: so that the liquid crystal twists and restores more quickly; and (3) inserting a fully black picture (for short, black insertion): inserting a fully black picture after each video picture has been displayed and before a next video picture is displayed.

However, if the way of changing the stickiness of the liquid crystal is used to improve the quality of the dynamically displayed pictures, other parameters and characteristics of the liquid crystal will be changed accordingly, which causes other disadvantageous effects. If the way of over driving is used, the driving voltage needs to be increased or voltage compensation needs to be adopted, which has a high requirement for the driving circuit. If the existing black insertion technology is used, a source driving circuit has to generate alternatively video data and fully black data. That is, the video data and the black insertion data are both generated by the source driving circuit. Since the source driving circuit has to generate black insertion voltages and data driving voltages at different time, the scanning frequency of a gate driving circuit has to be increased, for example doubled, tripled, and so on, whereby the load of the source driver increases considerably and the reaction speed of the source driver has to be improved accordingly.

SUMMARY OF THE INVENTION

In view of the above problems, embodiments of the invention provide a liquid crystal panel, a liquid crystal display and a driving method thereof, which can perform black insertion or grey insertion processing without increasing the driving frequency, and can have a precharge function.

In accordance with one embodiment of the invention, a liquid crystal panel comprises scanning lines, data lines, and a plurality of pixels, each of the plurality of pixels including a thin film transistor (TFT), a pixel electrode and a first common electrode. The first common electrodes of first pixels of a same row of pixels are electrically connected via a first common line, and the first common electrodes of second pixels of the same row of pixels are electrically connected via a second common line.

In accordance with another embodiment of the invention, a liquid crystal panel comprises scanning lines, data lines, and a plurality of pixels, each of the plurality of pixels including a TFT, a pixel electrode, and a first common electrode. The plurality of pixels comprise a first set of pixels and a second set of pixels. The first common electrodes of first pixels of the first set of pixels are electrically connected, and the first common electrodes of second pixels of the first set of pixels are electrically connected. The first common electrodes of first pixels of the second set of pixels are electrically connected, and the first common electrodes of second pixels of the second set of pixels are electrically connected.

In accordance with another embodiment of the invention, a liquid crystal display (LCD) includes a liquid crystal panel that comprises scanning lines, data lines, and a plurality of pixels, each of the plurality of pixels including a thin film transistor (TFT), a pixel electrode and a first common electrode. The plurality of pixels comprise first pixels and second pixels. The first common electrodes of the first pixels of a same row of pixels are electrically connected via a first common line, and the first common electrodes of the second pixels of the same row of pixels are electrically connected via a second common line.

In accordance with another embodiment of the invention, a liquid crystal display (LCD) includes a liquid crystal panel that comprises scanning lines, data lines, and a plurality of pixels, each of the plurality of pixels including a thin film transistor (TFT), a pixel electrode, and a first common electrode. The plurality of pixels comprises a first set of pixels and a second set of pixels. The first common electrodes of first pixels of the first set of pixels are electrically connected, and the first common electrodes of second pixels of the first set of pixels are electrically connected. The first common electrodes of first pixels of the second set of pixels are electrically connected, and the first common electrodes of second pixels of the second set of pixels are electrically connected.

In accordance with another embodiment of the invention, an LCD driving method is provided. The LCD includes a liquid crystal panel comprising scanning lines, data lines, and a plurality of pixels, the plurality of pixels comprising first pixels and second pixels, each pixel comprising a thin film transistor (TFT), a pixel electrode, a first common electrode and a second common electrode, the second common electrodes of the plurality of pixels being electrically connected, wherein the first common electrodes of the first pixels of the plurality of pixels are electrically connected, the first common electrodes of the second pixels of the plurality of pixels are electrically connected. The driving method comprises: applying data signals to the data lines; before the TFTs are turned on, inputting to the first common electrodes of the first pixels a first common voltage signal that has the same polarity as the data signal inputted to the first pixels, and inputting to the first common electrodes of the second pixels a second common voltage signal that has the same polarity as the data signal inputted to the second pixels and that has a polarity reverse from the first common voltage signal; and inputting a third common voltage signal to the second common electrodes of the first and second pixels.

As compared with the prior art, the invention carries out the technology of performing black insertion or grey insertion without increasing the driving frequency by providing a first and second common voltage signals in reverse polarities, and has a precharge function.

BRIEF DESCRIPTION OF THE DRAWINGS

The above and further advantages of the invention may be better understood by referring to the following description in conjunction with the accompanying drawings in which like reference numbers indicate identical or similar elements, and wherein.

DETAILED DESCRIPTION OF THE INVENTION

The exemplary embodiments will be described below in detail with reference to the accompanying drawings.

Although the following embodiments are described in detail in the case that an LCD employs dot-inversion driving, the embodiments of the invention are not limited thereto. For example, the LCD of the embodiments of the invention may also employ column-inversion driving. Any modification should be included in the protection scope of the claims of the invention so long as it does not deviate from the essence of the invention.

It will be described to the first embodiment of the invention first with reference to FIGS. 6 to 10B. The LCD of the first embodiment of the invention comprises a liquid crystal panel that includes an array substrate and a color filter substrate (also referred to as an opposite substrate).

Figure 1:
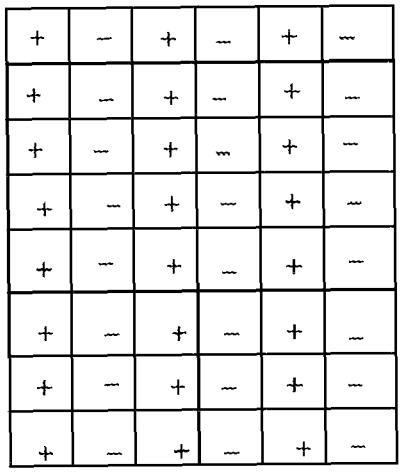
FIG. 1 (Prior art)
FIG. 1 is a schematic view of the polarities of pixels of the liquid crystal panel of a conventional LCD when the LCD employs the column-inversion driving.
Figure 2:
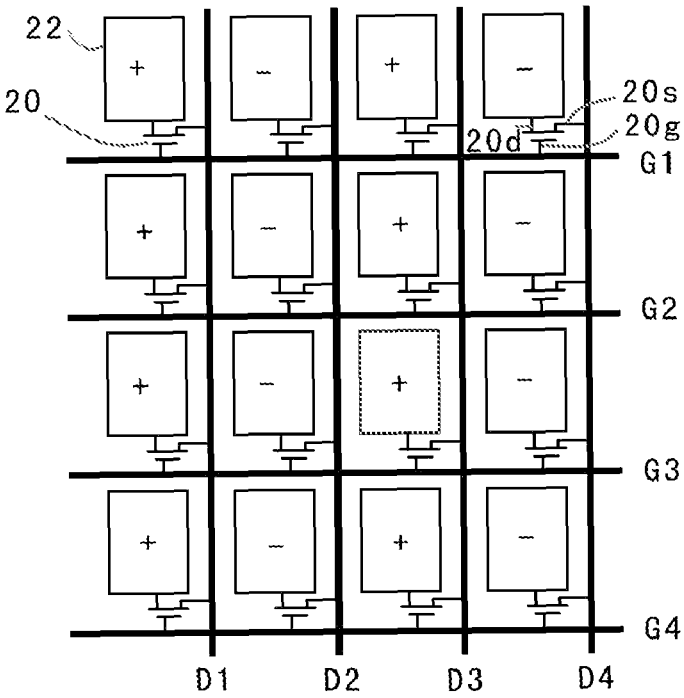
Fig. 2 (Prior Art)
FIG. 2 is a schematic circuit diagram of a portion of pixels of the liquid crystal panel as shown in FIG. 1.
Figures 3, 4:
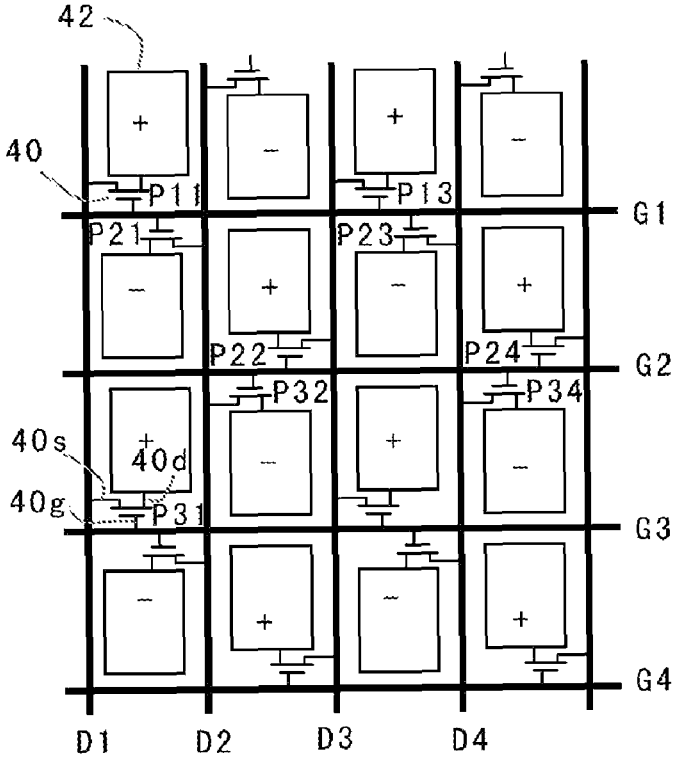
Fig. 3 (Prior Art)
Fig. 4 (Prior Art)
FIG. 3 is a schematic view of the polarities of pixels of the liquid crystal panel of a conventional LCD when the LCD employs the dot-inversion driving.
FIG. 4 is a schematic circuit diagram of a portion of pixels of the liquid crystal panel as shown in FIG. 3.
Figure 5A:
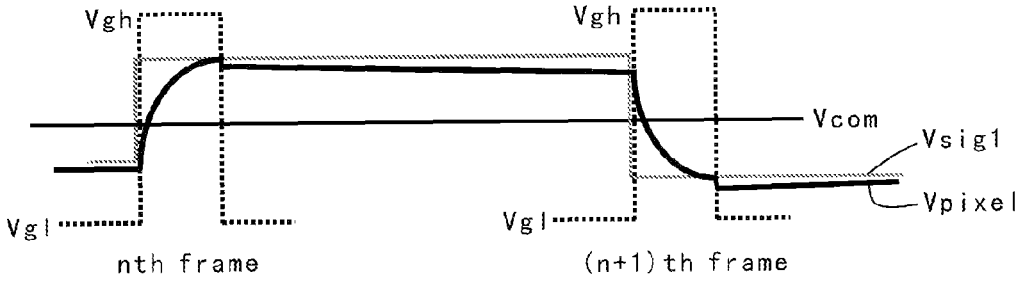
Fig. 5A (Prior Art)
FIGS. 5A and 5B are waveform diagrams of the pixel voltage, data signal voltage, common voltage signal and scanning signal of a certain pixel connected on an odd and even data lines as shown in FIGS. 2 and 4 respectively.
Figure 5B:
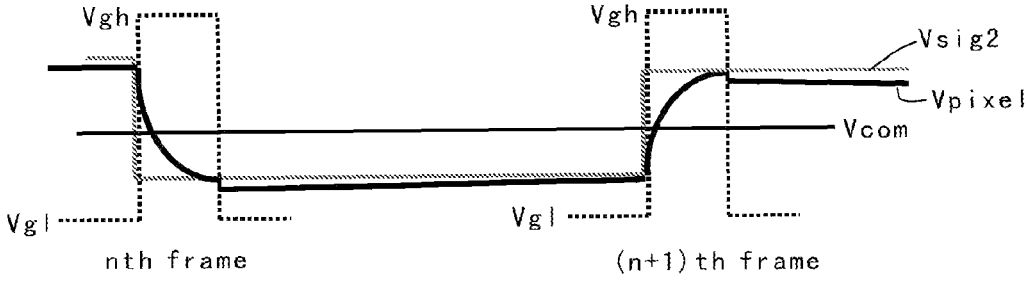
Fig. 5B (Prior Art)
Figure 6:
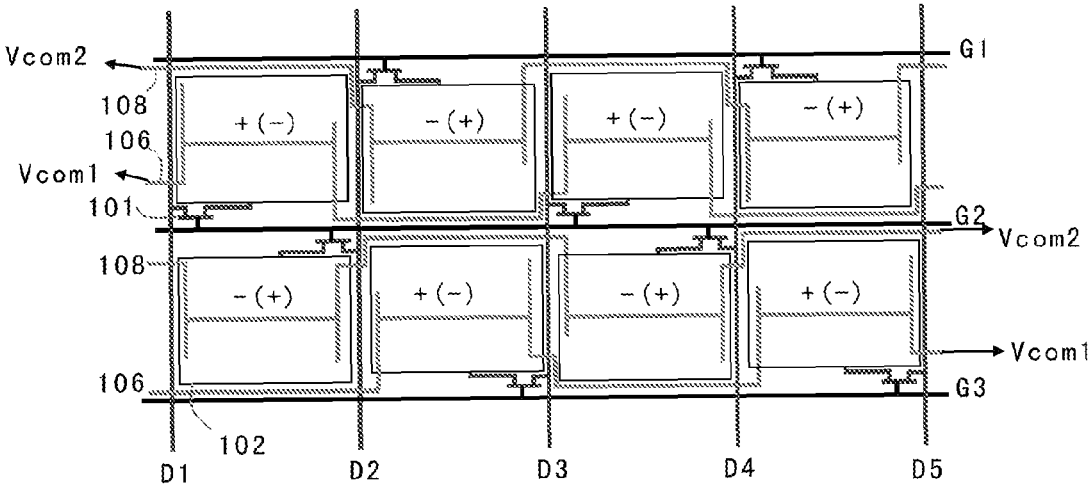
FIG. 6 is a schematic circuit diagram of a portion of pixels on an array substrate side of a liquid crystal panel of an LCD in accordance with a first embodiment of the invention when the LCD employs the dot-inversion driving.
Figure 7:
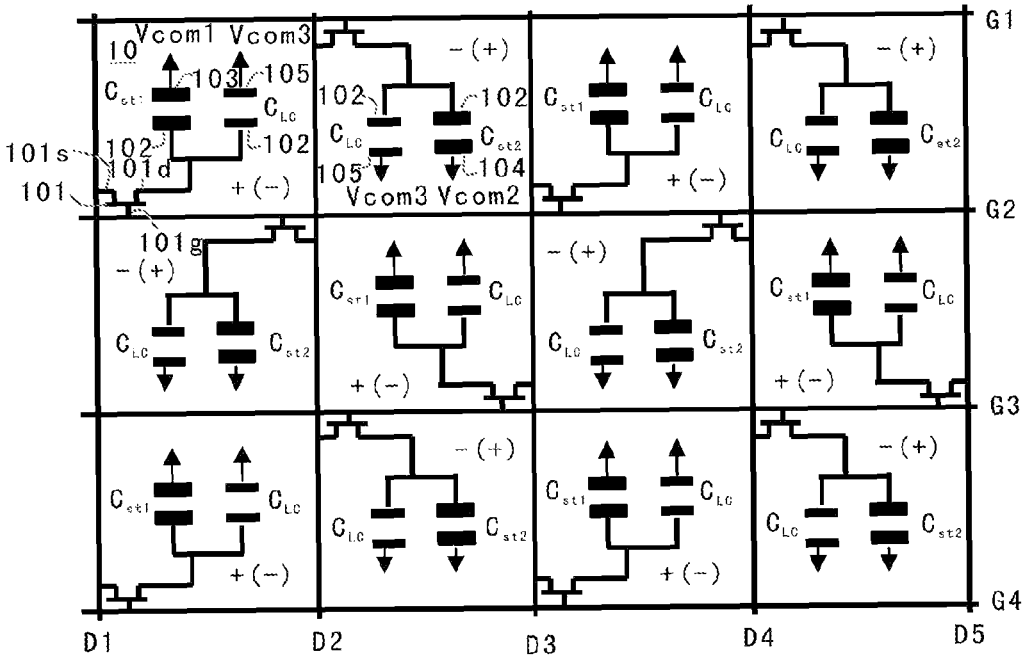
FIG. 7 is a schematic circuit diagram of a portion of pixels of the liquid crystal panel of the LCD in accordance with the first embodiment of the invention when the LCD employs the dot-inversion driving.

As shown in FIG. 7, the liquid crystal panel generally includes a plurality of pixels 10, and has data lines D1, D2, D3 . . . and scanning lines G1, G2, G3 . . . provided at the array substrate side. Each pixel 10 comprises a TFT 101, a liquid crystal capacitor $C_{LC}$, and a storage capacitor $C_{st}$ ($C_{st1}$ or $C_{st2}$). The first end of the storage capacitor $C_{st}$ is a pixel electrode 102, and the second end thereof is a common electrode 103 or 104 (referred to as the first common electrode, or storage electrode). The first end of the liquid crystal capacitor $C_{LC}$ is the pixel electrode 102, and the second end thereof is a common electrode 105 (referred to as the second common electrode, or opposite electrode) on the opposite substrate. A single scanning line of the scanning lines electrically connects the pixels of odd columns or the pixels of even columns of two adjacent rows of pixels. The TFTs 101 in the pixels of odd columns or in the pixels of even columns of two adjacent rows of pixels has gate electrodes 101*g* connected with the scanning lines (G1, G2 . . . ) to receive the scanning signals transmitted by the scanning lines. The odd data lines (D1, D3 . . . ) connect the pixels 10 that are positive in polarity for the current frame (referred to as the first pixels), and the even data lines (D2, D4 . . . ) connect the pixels 10 that are negative in polarity for the current frame (referred to as the second pixels). The second ends of storage capacitors $C_{st1}$ (i.e., the first common electrodes 103) in the first pixels are electrically connected via a first common line 106 that is used to receive a first common voltage signal Vcom1 (as shown in FIG. 6), and the second ends of storage capacitors $C_{st2}$ (i.e., the first common electrodes 104) in the second pixels are electrically connected via a second common line 108 that is used to receive a second common voltage signal Vcom2 (as shown in FIG. 6). The pixel electrodes 102 are coupled to the data lines (D1, D2 . . . ) via drain electrodes 101*d* and source electrodes 101*s* of TFTs 101. The second ends of liquid crystal capacitors $C_{LC}$ (i.e., the second common electrodes 105) in the plurality of pixels are electrically connected to receive a third common voltage signal Vcom3. In the embodiment, the first and second common voltage signals Vcom1 and Vcom2 are alternating current voltages (AC voltages), and the third common voltage signal Vcom3 is a direct current voltage (DC voltage).

The liquid crystal panel of an LCD, when employing column-inversion driving, has a connection type that is different from when employing dot-inversion driving in the following: a single scanning line of the scanning lines electrically connects all the pixels of the same row of pixels. Other connections of the liquid crystal panel are similar to those when employing dot-inversion driving, and therefore the detailed description thereof is omitted herein.

Figure 8A:
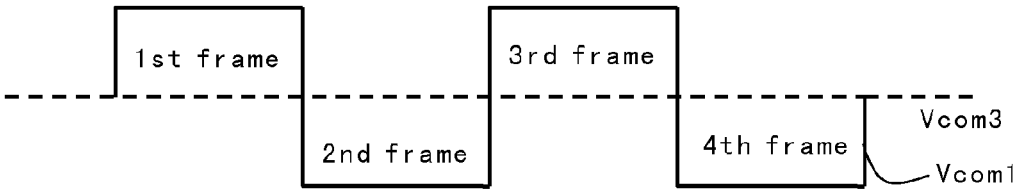
FIGS. 8A and 8B are waveform diagrams of common voltage signals of a certain pixel connected on the odd and even data lines in accordance with the first embodiment of the invention respectively.
Figure 8B:
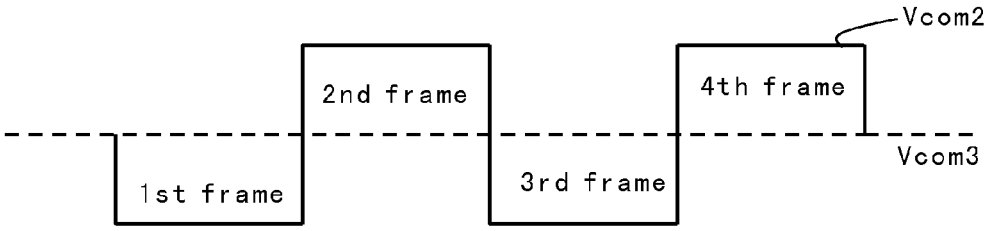

Refer to FIGS. 8A and 8B, which are waveform diagrams of the first and second common voltage signals Vcom1 and Vcom2 of the pixels connected on the odd and even data lines in accordance with the first embodiment of the invention respectively. The first common voltage signal Vcom1 has the same voltage amplitude and reverse polarity in a same frame as the second common voltage signal Vcom2 (that is, when the first common voltage signal Vcom1 is a high level, the second common voltage signal Vcom2 is a low level; and when the first common voltage signal Vcom1 is a low level, the second common voltage signal Vcom2 is a high level).

Figure 9A:
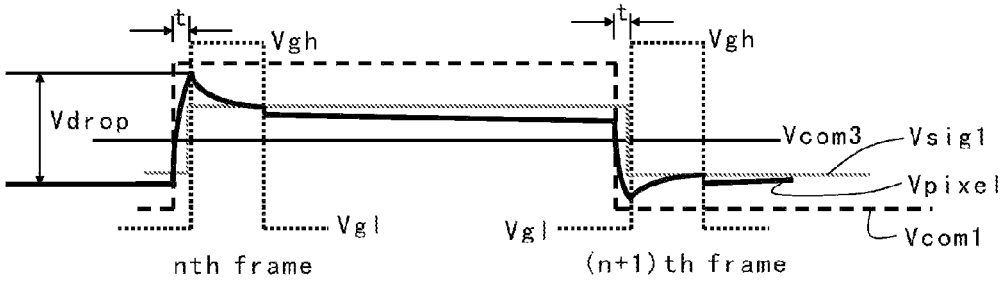
FIGS. 9A and 9B are waveform diagrams of the pixel voltage, data signal voltage, common voltage signal and scanning signal of a certain pixel connected on an odd and even data lines of the first embodiment of the invention respectively.
Figure 9B:
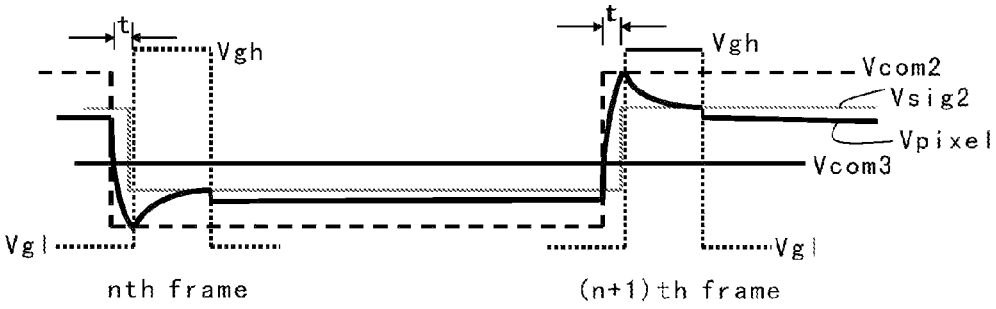

The waveforms of the pixel voltage, data signal voltage, common voltage signals and scanning signal of pixels of the first embodiment of the invention when they are driven are described below with reference to FIGS. 9A and 9B. In FIGS. 9A and 9B, Vgh represents the high voltage of scanning lines (also referred to as scanning start-up signal), Vgl represents the low voltage of the scanning lines, Vsig1 and Vsig2 represent data signal voltages supplied to data lines, Vpixel represents a voltage by which pixel electrodes 102 are charged (that is, pixel voltage), Vcom3 represents the third common voltage signal supplied to common electrodes 105 (i.e., the second common electrodes) of the liquid crystal capacitors $C_{LC}$ in pixels 10, and Vcom1 and Vcom2 represent the first and second common voltage signals supplied to common electrodes 103 and 104 (i.e., the first common electrodes) of storage capacitors $C_{st1}$ and $C_{st2}$ in the pixels 10 connected on the odd and even data lines respectively.

FIGS. 9A and 9B are waveform diagrams of the pixel voltage, data signal voltage, common voltage signal and scanning signal of a certain pixel connected on an odd and even data lines of the first embodiment of the invention respectively. For the purposes of clarity and ease of illustration, only the waveforms of the nth and (n+1)th frames are shown in FIGS. 9A and 9B. When the liquid crystal panel works, the first and second common voltage signals Vcom1 and Vcom2 are inputted in advance of the scanning start-up signal Vgh by time t, that is, the first and second common voltage signals Vcom1 and Vcom2 are inputted at the time that has a time t earlier than when a TFT 101 turns on, wherein t>Ton (Ton is the charge time by which a pixel electrode is changed from a minimum voltage to a maximum voltage). The first common voltage signal Vcom1 has the same polarity as the data signal voltage Vsig1 inputted to the first pixels after the TFT 101 turns on (that is, the first common voltage signal Vcom1 and the data signal voltage Vsig1 are both high levels or low levels), and the second common voltage signal Vcom2 has the same polarity as the data signal voltage Vsig2 inputted to the second pixels after the TFT 101 turns on (that is, the second common voltage signal Vcom2 and the data signal voltage Vsig2 are both high levels or low levels). The black-and-white response time $T_{response}$ of an LCD includes a charge time Ton by which the pixel electrode 102 is changed from the minimum voltage to the maximum voltage and a time Toff by which the pixel electrode 102 is changed from the maximum voltage to the minimum voltage, wherein Toff>Ton. For example, when an LCD having a black-and-white response time of 5 ms is used, the charge time Ton by which the pixel electrode 102 is changed from the minimum voltage to the maximum voltage is less than 2 ms, and in this case, t=2 ms may be used.

As shown in FIG. 9A, for the nth frame, at the time that has a time t earlier than when the TFT 101 turn on, the first common voltage signal Vcom1 starts to be inputted, and the pixel electrode 102 generates a coupling voltage Vdrop due to the capacitance coupling effect, $V_{drop}$ being obtained by:

$$V_{drop}=\Delta Vcom1\times C_{st}/(C_{LC}+C_{st}+C_{gs}), \quad (1)$$

Wherein ΔVcom1 is the change of the first common voltage signal Vcom1 (that is, when Vcom1 changes form the minimum value $Vcom1_{min}$ to the maximum value $Vcom1_{max}$, $\Delta Vcom1=Vcom1_{max}-Vcom1_{min}$, and when Vcom1 changes from the maximum value $Vcom1_{max}$ to the minimum value $Vcom1_{min}$, $\Delta Vcom1=Vcom1_{min}-Vcom1_{max}$), $C_{LC}$ is the liquid crystal capacitance, $C_{st}$ is the storage capacitance, and $C_{gs}$ is the capacitance between gate electrode and source electrode of the TFT.

Before charging the pixel electrode 102, that is, before the scanning start-up signal of the nth frame comes, a pixel 10 has a coupling voltage $V_{drop}$. The coupled pixel voltage $V_{coupled}$ is the sum of the pixel voltage of the (n−1)th frame and the coupling voltage $V_{drop}$. As shown in FIG. 9A, for the nth frame, since before charging the pixel electrode 102, the first common voltage signal Vcom1 has transited from the minimum value $Vcom1_{min}$ to the maximum value $Vcom1_{max}$, and it is known from the equation (1) that the coupling voltage $V_{drop}$ is a positive voltage at the time, the coupled pixel voltage $V_{coupled}$ increases, that is, the coupling voltage $V_{drop}$ has pulled the pixel electrode 102 from a negative polarity to a positive polarity. Therefore, when charging the pixel electrode 102, the pixel electrode 102 only needs to change from a voltage having a positive polarity to another voltage having a positive polarity, rather than changing from a voltage having a negative polarity to a voltage having a positive voltage as done conventionally, reducing the voltage difference that the pixel electrode 102 changes, and thus having the precharge function.

After the aforementioned time t, the scanning line is applied with the scanning start-up signal of the nth frame. The high voltage Vgh of the scanning signal turns on the TFTs 101 connected on the scanning line, that is, the drain electrodes 101*d* and source electrodes 101*s* of the TFTs 101 feed through. During this period, a data signal voltage Vsig1 that represents the pixel voltage of the nth frame is applied by the data line to the pixel electrodes 102 through the source electrodes 101*s* and drain electrodes 101*d* of the TFTs 101, whereby the pixels 10 connected on the scanning line transit from the coupled pixel voltage $V_{coupled}$ to the pixel voltage Vpixel of the nth frame and the storage capacitors $C_{st}$ in these pixels are in a charging state. The pixel voltage Vpixel is maintained by the storage capacitors within the subsequent time of the nth frame. Theoretically, the pixel voltage Vpixel shown by the pixels 10 connected on the scanning line will maintain unchanged before the scanning start-up signal of the (n+1)th frame is applied to the scanning line. In practice, however, at the moment the scanning signal transits from the high voltage Vgh to a low voltage Vgl, the TFTs 101 cut off, the charging voltages of the liquid crystal capacitors $C_{LC}$ that are maintained by the storage capacitors $C_{st}$ will drop suddenly due to the capacitance coupling effect, and decreases a little due to the influence of the adjacent parasitic resistances after the scanning signal keeps at the low voltage Vgl.

When the scanning start-up signal of the (n+1)th frame is applied to the scanning line, the polarity of the pixels connected on the scanning line is reversed. Similarly to the nth frame, at the time that has a time t earlier than when a TFT 101 turns on, the first common voltage signal Vcom1 transits from the maximum value $Vcom1_{max}$ to the minimum value $Vcom1_{min}$, and the pixel electrode 102 generates a coupling voltage $V_{drop}$ due to the capacitance coupling effect, the $V_{drop}$ being also obtained by the equation (1).

Similar to the nth frame, the coupled pixel voltage $V_{coupled}$ is the sum of the pixel voltage of the nth frame and the coupling voltage $V_{drop}$. As shown in FIG. 9A, for the (n+1)th frame, since the first common voltage signal Vcom1 has transited from the maximum value $Vcom1_{max}$ to the minimum value $Vcom1_{min}$, and it is known from the equation (1) that the $V_{drop}$ is a negative voltage at the time, the coupled pixel voltage $V_{coupled}$ decreases, that is, the coupling voltage $V_{drop}$ has pulled the pixel electrode 102 from a positive polarity to a negative polarity. Therefore, when charging the pixel electrode 102, the pixel electrode 102 only needs to change from a voltage having a negative polarity to another voltage having a negative polarity, rather than changing from a voltage having a positive polarity to a voltage having a negative voltage as in the prior art, reducing the voltage difference that the pixel electrode 102 changes, and thus having the precharge function.

After the time t, during applying the scanning start-up signal of the (n+1)th frame to the scanning line, the high voltage Vgh of the scanning signal turns on the TFTs 101 connected on the scanning line. Meanwhile, a data signal voltage Vsig1 that represents the pixel voltage of the (n+1)th frame is applied by the data line to the pixel electrodes through the source electrodes 101*s* and drain electrodes 101*d* of the TFTs 101, whereby the pixels 10 connected on the scanning line transit from the coupled pixel voltage $V_{coupled}$ to the pixel voltage Vpixel of the (n+1)th frame and the storage capacitors $C_{st}$ in the pixels 10 are in a charging state. After the TFTs turn off, the pixel voltage Vpixel of the (n+1)th frame is kept by the storage capacitors $C_{st}$. In practice, likewise, at the moment the scanning signal transits from the high voltage Vgh to a low voltage Vgl, the TFTs 101 cut off, the charging voltages of the liquid crystal capacitors $C_{LC}$ that are maintained by the storage capacitors $C_{st}$ will drop suddenly due to the capacitance coupling effect, and decreases a little due to the influence of the adjacent parasitic resistances after the scanning signal keeps at the low voltage Vgl. It repeats continuously as such.

FIG. 9B is a waveform diagram of the pixel voltage, data signal voltage, second common voltage signal and scanning signal of a certain pixel connected on an even data line. Because the polarity of the second pixels connected on the even data lines is inverse in a same frame from that of the first pixels connected on the odd data lines, and the polarity of the first common voltage signal is inverse in a same frame from that of the second common voltage signal, the waveform of the pixel voltage of the second pixels connected on even data lines is inverted from that of the first pixels connected on odd data lines, and the waveform of the second common voltage signal is also inverted from that of the first common voltage signal. Since in this case, FIG. 9B can be clearly understood with reference to the description made in FIG. 9A, the detailed description thereof is omitted herein.

The driving simulation of the liquid crystal panel in accordance with the first embodiment will be described below with reference to FIGS. 10A and 10B. Because of the constraint of the practical simulating instruments and the conditions, 12 scanning lines will be simulated on the basis of 60 Hz and the scanning time of a single one out of 900 scanning lines.

Figure 10A:
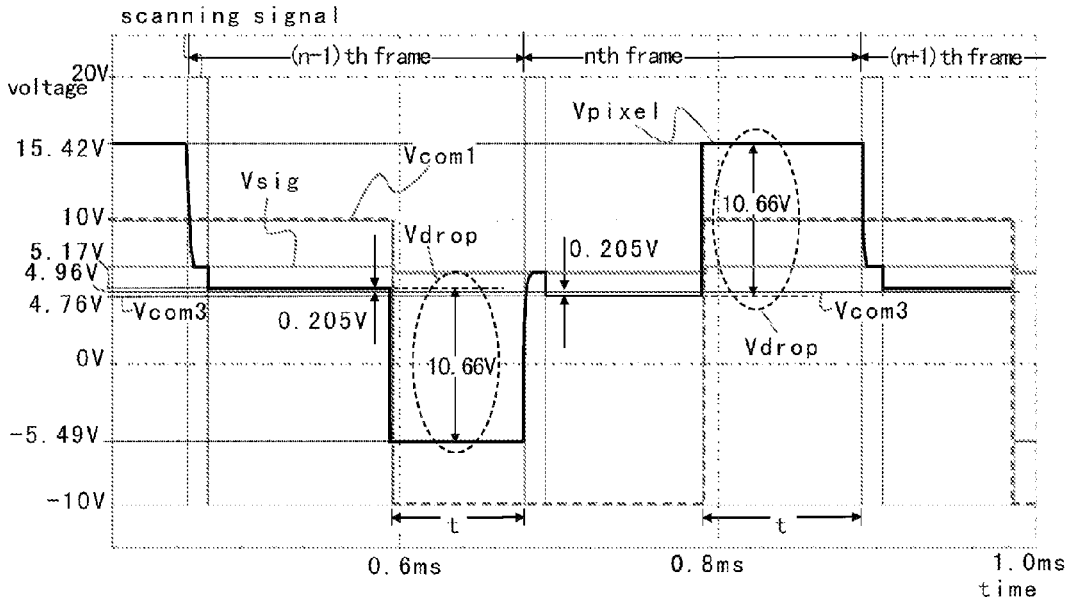
FIGS. 10A and 10B are diagrams of the driving simulation of the liquid crystal panel in accordance with the first embodiment of the invention in two cases respectively.

Referring to FIG. 10A, which illustrates a diagram of the driving simulation of the liquid crystal panel of the first embodiment in one case. The diagram is achieved under the following parameters: the high voltage of the scanning signal Vgh=20V, the low voltage of the scanning signal Vgl=−10V; the high voltage of the data signal Vdh1=6.7V, low voltage of the data signal Vdl1=6.3V (these data signal voltages correspond to the voltages of the brightest grey level L255 of the 256-level brightness, that is, the case of inputting white voltage signals); the length of the TFTs=4.5 μm, the width of the TFTs=31.7 μm; storage capacitance $C_{st}$=346.67 fF, the capacitance between the gate electrode and source electrode of a TFT $C_{gs}$=28.96 fF, liquid crystal capacitance $C_{LC}$=273.355 fF; the maximum value of the first common voltage signal $Vcom1_{max}$=10V, the minimum value of the first common voltage signal $Vcom1_{min}$=−10V, the third common voltage signal Vcom3=4.965V.

The pixel voltage of the (n−1)th frame is 5.17V. At the time that has a time t earlier than when the scanning start-up signal of the nth frame is applied to the scanning line, the first common voltage signal Vcom1 changes from 10V to −10V, and the pixel electrode generates a coupling voltage $V_{drop}$ due to the capacitance coupling effect. As shown in FIG. 10A, $V_{drop}$ is −10.66V. Therefore, the coupled pixel voltage is (5.17−10.66)=−5.49V, and the voltage difference between the coupled pixel voltage and the third common voltage signal Vcom3 (that is, the voltage difference of the liquid crystal capacitor) is (4.965−(−5.49))=10.455V.

After the time t, the scanning line is applied with the scanning start-up signal of the nth frame. The high voltage Vgh of the scanning signal turns on the TFTs connected on the scanning line. During this period, the low voltage Vdl1 of the data signal that represents the pixel voltage of the nth frame is applied by a data line to the pixel electrodes via source electrodes and drain electrodes of the TFTs, whereby the pixels connected on the scanning line transit from the coupled pixel voltage $V_{coupled}$ (−5.49V) to the low voltage 6.3V of the data signal and the storage capacitors in the pixels connected on the scanning line are in a charging state. At the moment the scanning signal transits from the high voltage Vgh to the low voltage Vgl, the TFTs cut off, the charging voltages of the liquid crystal capacitors that are maintained by the storage capacitors will drop suddenly due to the capacitance coupling effect, generating a feed-through voltage (6.3−4.76)=1.54V, and keeps at 4.76V thereafter.

At the time that has a time t earlier than when the scanning start-up signal of the (n+1)th frame is applied to the scanning line, the first common voltage signal Vcom1 changes from −10V to 10V, and the pixel electrode generates a coupling voltage $V_{drop}$ due to the capacitance coupling effect. As shown in FIG. 10A, the coupling voltage $V_{drop}$ is 10.66V Therefore, the coupled pixel voltage $V_{coupled}$ is (4.76+10.66) =15.42V, and the voltage difference between the coupled pixel voltage $V_{coupled}$ and the third common voltage signal Vcom3 (that is, the voltage difference of the liquid crystal capacitor) is (15.42−4.965)=10.455V.

After the time t, the scanning line is applied with the scanning start-up signal of the (n+1)th frame. The high voltage Vgh of the scanning signal turns on the TFTs connected on the scanning line. During this period, the high voltage Vdh1 of the data signal that represents the pixel voltage of the (n+1)th frame is applied by a data line to the pixel electrodes via source electrodes and drain electrodes of the TFTs, whereby the pixels connected on the scanning line transit from the coupled pixel voltage $V_{coupled}$ (15.42V) to the high voltage 6.7V of the data signal and the storage capacitors in the pixels connected on the scanning line are in a charging state. At the moment the scanning signal transits from the high voltage Vgh to the low voltage Vgl, the TFTs cut off, the charging voltage of the liquid crystal capacitors that are maintained by the storage capacitors will drop suddenly due to the capacitance coupling effect, generating a feed-through voltage (6.7−5.17)=1.53V, and keeps at 5.17V thereafter. It repeats continuously as such.

It can be seen that in the case of FIG. 10A, the coupled pixel voltages $V_{coupled}$ are −5.49V and 15.42V respectively. The voltage differences between each of the two voltages and the third common voltage signal Vcom3 (Vcom3=4.965V) are both 10.455V, larger than 6V. Therefore, in the case of using an LCD whose voltage difference corresponding to the darkest grey level is 6V, when the inputs are white voltage signals (that is, signals of the brightest level), the pixels have a good black insertion effect.

Figure 10B:
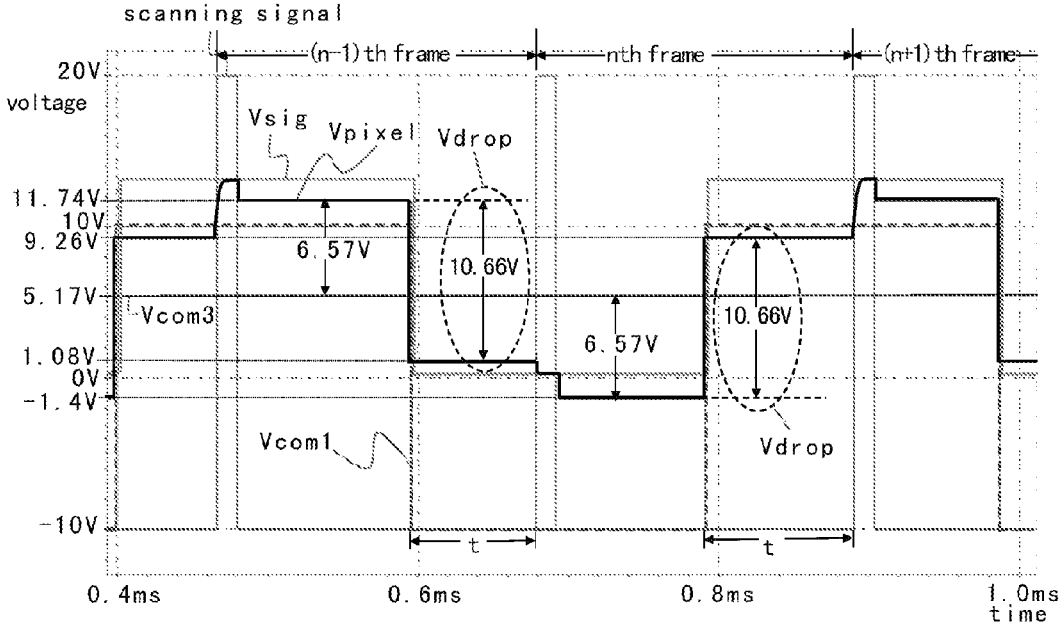

Referring to FIG. 10B, which illustrates a diagram of the driving simulation of the liquid crystal panel of the first embodiment in another case. The diagram is achieved under the following parameters: the high voltage of the scanning signal Vgh=20V, the low voltage of the scanning signal Vgl=−10V; the high voltage of the data signal Vdh2=13.2V, low voltage of the data signal Vdl2=0.2V (these data signal voltages correspond to the voltages of the darkest grey level L0 of the 256-level brightness, that is, the case of inputting black voltage signals); the length of the TFTs=4.5 μm, the width of the TFTs=31.7 μm; storage capacitance $C_{st}$=346.67 fF, the capacitance between the gate electrode and source electrode of a TFT Cgs=28.96 fF, liquid crystal capacitance $C_{LC}$=2730.355 fF; the maximum value of the first common voltage signal $Vcom1_{max}$=10V, the minimum value of the first common voltage signal $Vcom1_{min}$=−10V, the third common voltage signal Vcom3=5.17V.

The pixel voltage of the (n−1)th frame is 11.74V. At the time that has a time t earlier than when the scanning start-up signal of the nth frame is applied to the scanning line, the first common voltage signal Vcom1 changes from 10V to −10V, and the pixel electrode generates a coupling voltage $V_{drop}$ due to the capacitance coupling effect. As shown in FIG. 10B, the coupling voltage Vdrop is −10.66V. Therefore, the coupled pixel voltage is (11.74−10.66)=1.08V, and the voltage difference between the coupled pixel voltage $V_{coupled}$ and the third common voltage signal Vcom3 (that is, the voltage difference of the liquid crystal capacitor) is (5.17−1.08)=4.09V.

After the time t, the scanning line is applied with the scanning start-up signal of the nth frame. The high voltage Vgh of the scanning signal turns on the TFTs connected on the scanning line. During this period, the low voltage Vdl2 of the data signal that represents the pixel voltage of the nth frame is applied by a data line to the pixel electrodes via source electrodes and drain electrodes of the TFTs, whereby the pixels connected on the scanning line transit from the coupled pixel voltage $V_{coupled}$ (1.08V) to the low voltage 0.2V of the data signal and the storage capacitors in the pixels connected on the scanning line are in a charging state. At the moment the scanning signal transits from the high voltage Vgh to the low voltage Vgl, the TFTs cut off, the charging voltages of the liquid crystal capacitors that are maintained by the storage capacitors will drop suddenly due to the capacitance coupling effect, generating a feed-through voltage (0.2−(−1.4))=1.6V, and keeps at −1.4V thereafter.

At the time that has a time t earlier than when the scanning start-up signal of the (n+1)th frame is applied to the scanning line, the first common voltage signal Vcom1 changes from −10V to 10V, and the pixel electrode generates a coupling voltage $V_{drop}$ due to the capacitance coupling effect. As shown in FIG. 10B, the coupling voltage $V_{drop}$ is 10.66V. Therefore, the coupled pixel voltage $V_{coupled}$ is (−1.4+10.66)= 9.26V, and the voltage difference between the coupled pixel voltage $V_{coupled}$ and the third common voltage signal Vcom3 (that is, the voltage difference of the liquid crystal capacitor) is (9.26−5.17)=4.09V.

After the time t, the scanning line is applied with the scanning start-up signal of the (n+1)th frame. The high voltage Vgh of the scanning signal turns on the TFTs connected on the scanning line. During this period, the high voltage Vdh2 of the data signal that represents the pixel voltage of the (n+1)th frame is applied by a data line to the pixel electrodes via source electrodes and drain electrodes of the TFTs, whereby the pixels connected on the scanning line transit from the coupled pixel voltage $V_{coupled}$ (9.26V) to the high voltage 13.2V of the data signal and the storage capacitors in the pixels connected on the scanning line are in a charging state. At the moment the scanning signal transits from the high voltage Vgh to the low voltage Vgl, the TFTs cut off, the charging voltages of the liquid crystal capacitors that are maintained by the storage capacitors will drop suddenly due to the capacitance coupling effect, generating a feed-through voltage (13.2−11.74)=1.46V, and keeps at 11.74V thereafter. It repeats continuously as such.

It can be seen that in the case of FIG. 10B, the coupled pixel voltages $V_{coupled}$ are 1.08V and 9.26V respectively. The voltage differences between each of the two voltages and the third common voltage signal Vcom3 (Vcom3=5.17V) are both 4.09V, less than 6V. Therefore, in the case of using an LCD whose voltage difference corresponding to the darkest grey level is 6V, when the inputs are black voltage signals (that is, signals of the darkest level), the pixels have grey insertion effect only.

Therefore, the embodiment of the invention achieves good black insertion or grey insertion effect without increasing the driving frequency by adding a coupling voltage $V_{drop}$ to the pixel electrodes before the scanning start-up signal is applied to the scanning lines.

Figure 11:
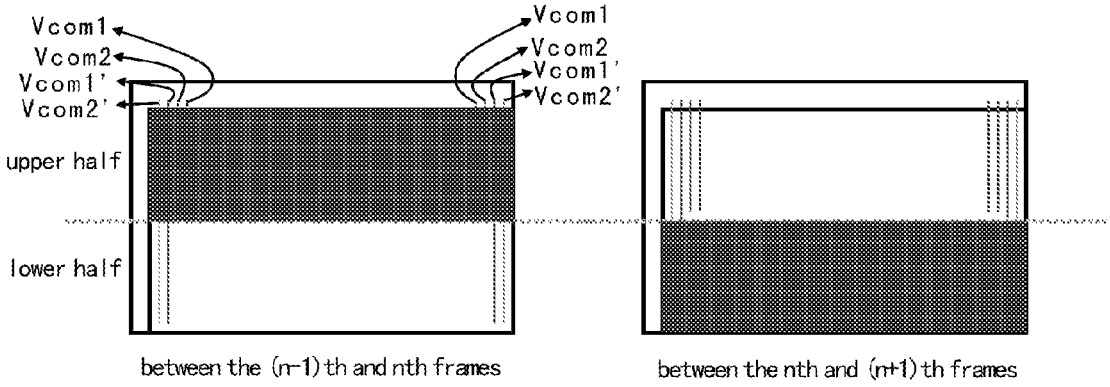
FIG. 11 is a schematic diagram of the black insertion of ½ screen in accordance with a second embodiment of the invention.
Figure 12:
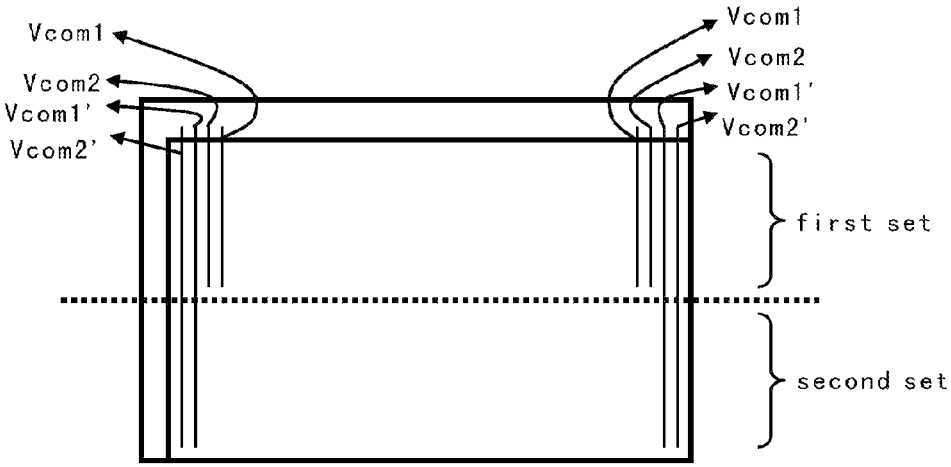
FIG. 12 is a schematic diagram of an implementation of FIG. 11.

The second embodiment of the present invention will be described below with reference to FIGS. 11 and 12. In order to improve the brightness of display, the second embodiment of the invention may implement a rolling black insertion of part of a screen, such as black insertion of ½ screen, black insertion of ⅓ screen, etc., rather than black insertion of the full screen. The partial screen black insertion can be implemented by modifying the design of the invention slightly. FIG. 11 is a schematic diagram of the ½ screen black insertion in accordance with the second embodiment of the invention. As shown in FIG. 11, the upper half of the screen is black inserted between the (n−1)th frame and the nth frame, and the lower half of the screen is black inserted between the nth frame and the (n+1)th frame. The two halves of the screen are black inserted in a rolling manner as such. The implementation of FIG. 11 is illustrated in FIG. 12, wherein the first common electrodes of the first and second pixels connected on the odd and even data lines of the upper half of screen are connected to the first and second common voltage signals Vcom1 and Vcom2 respectively, whereas the first common electrodes of the first and second pixels connected on the odd and even data lines of the lower half of screen are connected to the fourth and fifth common voltage signals Vcom1' and Vcom2'. The black insertion of ½ screen can be implemented by controlling the input time of Vcom1, Vcom2 and Vcom1', Vcom2'.

As shown in FIG. 12, the pixels of the liquid crystal panel of the second embodiment of the invention comprise a first set of pixels and a second set of pixels. The first common electrodes of the first pixels out of the first set of pixels are electrically connected to receive the first common voltage signal Vcom1, and the first common electrodes of the second pixels out of the first set of pixels are electrically connected to receive the second common voltage signal Vcom2; the first common electrodes of the first pixels out of the second set of pixels are electrically connected to receive the fourth common voltage signal Vcom1', and the first common electrodes of the second pixels out of the second set of pixels are electrically connected to receive the fifth common voltage signal Vcom2'. In addition, the second common electrodes of the two sets of pixels are electrically connected to receive the third common voltage signal Vcom3. The first and second common voltage signals Vcom1 and Vcom2 are AC voltages, and have the same amplitude and reverse polarities in a same frame; the fourth and fifth common voltage signals Vcom1' and Vcom2' are AC voltages, and have the same amplitude and reverse polarities in a same frame. In this way, similar to the first embodiment, the first set of pixels can be black inserted and precharged by the first and second common voltage signals Vcom1 and Vcom2, and the second set of pixels can be black inserted and precharged by the fourth and firth common voltage signals Vcom1' and Vcom2'. Moreover, by setting the first and fourth common voltage signals Vcom1 and Vcom1' only different in timings, and setting the second and fifth common voltage signals Vcom2 and Vcom2' only different in timings, black insertion can be performed for the first set of pixels and the second set of pixels in different timings. For example, the first and second common voltage signals Vcom1 and Vcom2 are inputted in advance of the scanning start-up signal by a time t in odd frames, and the fourth and firth common voltage signals Vcom1' and Vcom2' are inputted in advance of the scanning start-up signal by a time t in even frames. In this case, the first set of pixels can be black inserted in odd frames, and the second set of pixels can be black inserted in even frames, thereby implementing rolling black insertion of partial screens.

Since the specific structure of the second embodiment of the invention is the same as that of the first embodiment except adding the fourth and fifth common voltage signals Vcom1' and Vcom2', the detailed description thereof is omitted herein.

The above detailed description is made in the example of black insertion of ½ screen, but the invention is not limited thereto. The pixels of the liquid crystal panel of an embodiment of the invention may comprise a third set of pixels, comprise a third set of pixels and a fourth set of pixels, and so on. For example, when black insertion of ⅓ screen is performed, the pixels of the liquid crystal panel of an embodiment of the invention comprise three sets of pixels, i.e., a first set of pixels, a second set of pixels, and a third set of pixels; alternatively, when black insertion of ¼ screen is performed, the pixels of the liquid crystal panel of an embodiment of the invention comprise four sets of pixels, i.e., a first set of pixels, a second set of pixels, a third set of pixels, and a fourth set of pixels; when black insertion of 1/n screen is performed, the pixels of the liquid crystal panel of an embodiment of the invention comprise n sets of pixels, i.e., a first set of pixels, a second set of pixels, a third set of pixels . . . , a (n−1)th set of pixels, and an nth set of pixels.

Although the specific embodiments of the invention are described in detail herein, those skilled in the art will recognize that various modifications, variations and replacements may be made without departing from the spirit and scope of the invention. Therefore, the scope of the invention is merely defined by the appended claims and its equivalents.

What is claimed is:

1. A liquid crystal display (LCD) including a liquid crystal panel that comprises scanning lines, data lines, and a plurality of pixels, each of the plurality of pixels including a thin film transistor (TFT), a pixel electrode, a first common electrode, and a second common electrode, wherein:

the plurality of pixels comprises a first set of pixels and a second set of pixels;

the first common electrodes of first pixels of the first set of pixels are electrically connected and configured to receive a first common voltage signal, and the first common electrodes of second pixels of the first set of pixels are electrically connected and configured to receive a second common voltage signal;

the first common electrodes of first pixels of the second set of pixels are electrically connected and configured to receive a fourth common voltage signal, and the first common electrodes of second pixels of the second set of pixels are electrically connected and configured to receive a fifth common voltage signal;

the second common electrodes of the plurality of pixels being electrically connected; and the first and second common voltage signals are AC voltage signals, and have reverse polarities in a same frame; and the fourth and fifth common voltage signals are AC voltage signals, and have reverse polarities in a same frame.

2. The LCD of claim 1, wherein the first and fourth common voltage signals have different timings, and the second and fifth common voltage signals have different timings.

3. A driving method of a liquid crystal display (LCD), the LCD including a liquid crystal panel comprising scanning lines, data lines, and a plurality of pixels, the plurality of pixels comprising first pixels and second pixels, each pixel comprising a thin film transistor (TFT), a pixel electrode, a first common electrode and a second common electrode, the second common electrodes of the plurality of pixels being electrically connected, wherein the first common electrodes of the first pixels of the plurality of pixels are electrically connected, the first common electrodes of the second pixels of the plurality of pixels are electrically connected, and the driving method comprises:

applying data signals to the data lines;

before the TFTs are turned on, inputting to the first common electrodes of the first pixels a first common voltage signal that has the same polarity as the data signal inputted to the first pixels, and inputting to the first common electrodes of the second pixels a second common voltage signal that has the same polarity as the data signal inputted to the second pixels and that has a polarity reverse from the first common voltage signal; and inputting a third common voltage signal to the second common electrodes of the first and second pixels.

4. The driving method of the LCD of claim 3, wherein at a predetermined time that is earlier than when the TFTs are turned on, the first common voltage signal is inputted to first common electrodes of the first pixels, and the second common voltage signal is inputted to the first common electrodes of the second pixels, the predetermined time being larger than a charging time by which a pixel is changed from the minimum voltage to the maximum voltage.

* * * * *